United States Patent [19]

Belbel et al.

[11] Patent Number: 4,682,132

[45] Date of Patent: Jul. 21, 1987

[54] REMOTE CONTROL CIRCUIT BREAKER HAVING A RETRACTABLE SWITCH CONTACT

[75] Inventors: Elie Belbel, Epinay sur Seine; Christian Bataille, Ville d'Avray; Christian Blanchard, Rueil Malmaison; André Haury, Le Raincy; Michel Lauraire, Courbevoie, all of France

[73] Assignee: La Telemecanique Electrique, France

[21] Appl. No.: 820,297

[22] Filed: Jan. 21, 1986

[30] Foreign Application Priority Data

Nov. 15, 1985 [FR] France ..... 85 17209

[51] Int. Cl.[4] ..... H01H 75/00; H01H 77/00; H01H 83/00

[52] U.S. Cl. ..... 335/14; 335/6; 335/20

[58] Field of Search ..... 335/6, 9, 14, 20, 147, 335/195

[56] References Cited

U.S. PATENT DOCUMENTS 3,071,664 1/1963 Priesmuth ..... 335/61
3,469,216 9/1969 Shiraishi ..... 335/195
4,473,860 9/1984 Thomas ..... 335/6
4,604,596 8/1986 Yokoyama ..... 335/16

*Primary Examiner*—E. A. Goldberg
*Assistant Examiner*—Lincoln Donovan
*Attorney, Agent, or Firm*—William A. Drucker

[57] ABSTRACT

A circuit breaker is provided with at least one switching arrangement having a mobile contact and a retractable contact, this latter being supported by a pivoting lever; a tripping mechanism for causing rapid opening of the mobile contact, an electromagnetic actuator having an element movable in translation under the effect of a control signal applied to the actuator and a mechanical coupling element for transmitting the movement of the mobile element to the retractable contact, wherein the mechanical coupling element, rigid and movable in translation parallel to the axis of displacement of the mobile element, is coupled to one end of the pivoting lever and, at its opposite contact end, the pivoting lever has an arm bent so that an end portion of substantial length of the arm is substantially parallel to the opposite arm of the corresponding mobile contact lever, the pivoting axis of the pivoting lever being placed between its bend and the coupling end.

8 Claims, 10 Drawing Figures

REMOTE CONTROL CIRCUIT BREAKER HAVING A RETRACTABLE SWITCH CONTACT

BACKGROUND OF THE INVENTION

1. Field of the Invention

The invention relates to a circuit breaker, more particularly a multiphase circuit breaker, comprising a quick trip mechanism which may be set and tripped by means of a local manual control member, a multiplicity of power circuits each comprising a switch device whose mobile contact is connected to said mechanism so as to be closed or opened thereby, detectors which react to overcurrents of different kinds in these circuits by causing tripping of said mechanism and, consequently, the automatic opening of the switch device, and an electromagnet causing remote controlled opening of a retractable contact of this switch without causing tripping of this mechanism.

2. Description of the Prior Art

From Pat. No. 84 17505 filed on the Nov. 16, 1984 in the name of the applicant for: "Circuit breaker apparatus with remote controlled opening and closing of its circuits", a circuit breaker of the above mentioned type is known in which the fixed contact of each switch member is carried by a pivoting conducting lever actuated by means of a single transmission means, by the armature of an electromagnet which has no connection with the quick trip mechanism.

The embodiments proposed in this patent for the transmission means are relatively complex.

SUMMARY OF THE INVENTION

The invention proposes an arrangement of transmission means which, while allowing satisfactory amplification of the movement of the retractable contacts with respect to the stroke of the armature to be obtained and the tripping mechanism, the detectors and different means comprised by a traditional circuit breaker to be used without having to appreciably modify the structure or the arrangement thereof, uses the repulsion forces which appear between the contact levers in the case of a high current overload for causing rapid opening of the mobile contact and, possibly, of the retractable contact.

According to the invention, this result is obtained because the means transmitting the movement of the armature of the electromagnet to the retractable contact pivoting levers, rigid and movable in translation parallel to the displacement axis of the mobile element, is coupled to one end of said pivoting lever centered on said axis and because, at its opposite contact end, said pivoting lever has an arm bent so that an end portion of substantial length of said arm is substantially parallel to the arm opposite the corresponding mobile contact lever, the pivoting axis of said pivoting lever being placed between its bend and said coupling end.

In a preferred embodiment, said transmission means comprises a resilient connecting element adapted for causing opening of the retractable contact under the effect of the repulsion forces generated in the case of a high current overload, whereas said mobile element is in the position of said transmission means which corresponds normally to closure of the retractable contact.

BRIEF DESCRIPTION OF THE DRAWINGS

Other features and advantages of the invention will be clear from the following description, given by way of example with reference to the following drawings in which.

DESCRIPTION OF THE PREFERRED EMBODIMENTS

Figure 1:
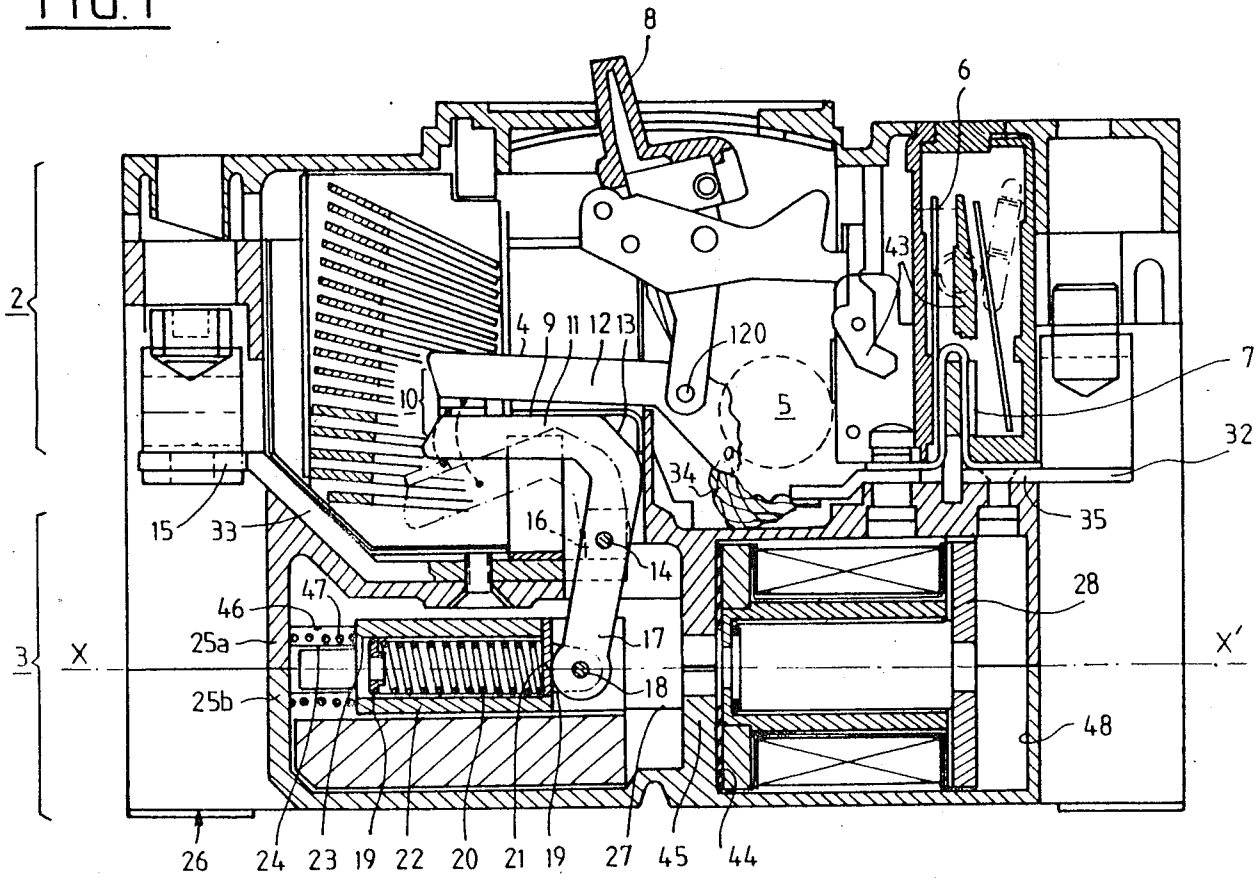
FIG. 1 is a sectional view of a circuit breaker with automatic control according to a preferred embodiment of the invention.

The apparatus shown in the drawings result from the combination of a known type of circuit breaker 2 and an electromagnet remote control assembly 3.

The circuit breaker 2 has a mobile contact lever 4 which may either be moved by setting and the sudden tripping of a force accumulating mechanism 5 by means of an external handle 8 or be tripped automatically by current detectors 6, 7. The detector 6 is responsive to a moderate but prolonged overcurrent whereas detector 7 is responsive to an overcurrent having a rapid growth. In the closure position of switch 10, shown in FIG. 1, the mobile contact lever is resiliently applied against a second retractable contact lever 9. This circuit breaker part of the apparatus is of a type known per se and will therefore not be described in detail.

Lever 9 comprises a portion 11 parallel to the arms 12 of lever 4 over as large an extent as possible. This lever 9 has then a bend 13 and comprises, beyond the bend, a second portion 17 having a pivot 14. The current is transmitted to a terminal 15 by concentric resilient clips 16. Finally lever 9 has, in its portion 17, an articulation 18 connected to a U shaped stirrup piece 19 between the legs of which is placed a compression spring 20 which bears against a cross piece 21 carried by an insulating slider 22, a housing 23 of which guides the stirrup piece 19. This slider, which is guided in slides 24 of the case 25*a*–25*b* in a direction XX′ substantially parallel to the base 26 of the apparatus, is connected by extensions such as 27 to an armature 28 of an electromagnet 29 further comprising a fixed yoke 30 integral with the case and an energizing coil 31. When the electromagnet is energized, the armature is in the position shown in the Figure and portion 17 of the lever is applied against the cross piece 21.

The current flows between terminal 15 and another terminal 32 after flowing through a piece 33 connected to clip 16, switch 10, a braided connecting wire 34, detectors 6, 7 and piece 35.

When this circuit has an excessive overcurrent flowing therethrough, resulting for example from a short circuit, repulsion forces developed between the two parallel arms 11–12 move lever 9 aside, which causes a compression of spring 20 which does not modify the position of the slider 22; in a time sufficiently short for lever 9 not to have come back to its initial position, a current detector (6 or 7) will also have reacted for tripping the mechanism 5 and opening the lever 4 of the mobile contact.

It will be noted that the repulsion forces cause immediate opening of the retractable contact 9, whereas the current detectors have a certain releasing time. In other words, the contact 9 whose main opening mode is, as will be explained further on, that which results from remote control thereof by de-energization of the auxiliary electromagnet 29, has the advantage of opening also in the case of a short circuit and causing cut-out as well as more rapid opening of the circuit than that caused by detectors 6–7 normally provided for this purpose.

Figure 6:
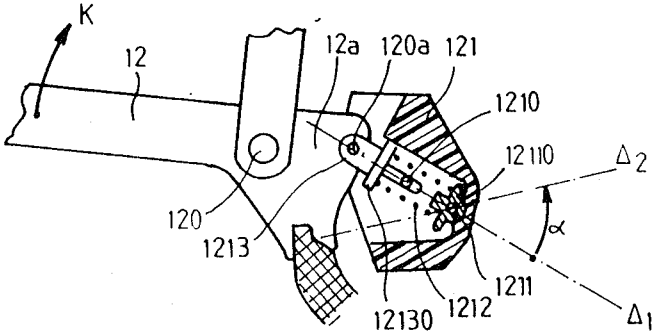
FIG. 6 shows a device for resilient locking of the mobile contact lever.

In fact, in the embodiment described, as will be explained in greater detail with reference to FIG. 6, the mobile contact is also subjected to these repulsion forces, so that the two contacts open together.

The result is that the distance which separates them reaches a greater value than if the mobile contact alone moved, which increases the cut-out power of the circuit breaker. It will be noted that the double bend form of the retractable contact is such that, on the one hand, the end portion opposite the mobile contact and parallel thereto at closure has a great length, (which allows high repulsion forces to be developed) and, on the other hand, such that the retractable contact is moved away over a considerable distance, which further reinforces the cutout power in the case of a short circuit.

Remote controlled opening is provided, in the absence of a fault current, by de-energization of the electromagnet 29: the armature 28 moves to the right in FIG. 1 and lever 9 then assumes the position shown with a broken line.

De-energization of the electromagnet may also be caused by the current detectors for further providing confirmation of opening.

Figure 3:
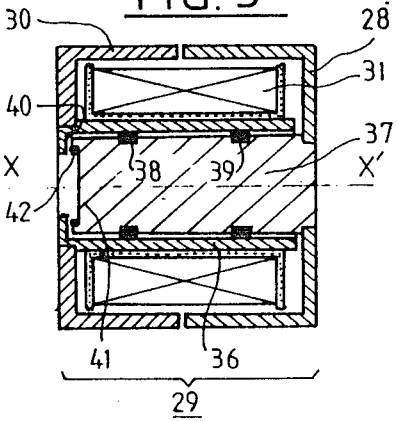
FIG. 3 is a sectional view of the electromagnet for illustrating the damping device which it comprises.

The electromagnet is shown in greater detail in FIG. 3 where it can be seen that yoke 30 and the armature 28 both have a U shape; the yoke 30 is integral with a magnetizable sleeve 36 on which coil 31 is fitted and inside which slides a core 37 integral with the armature. A sliding fit without play and with low friction is obtained by using two "teflon" segments 38, 39 carried by the core. Between the bottom of the bore 40 of the sleeve and the end 41 of the core is disposed a damping piece 42 (for example formed by an elastomer O-seal) so as not to communicate impacts to the tripping mechanism 43 connected to the detectors likely to cause untimely operation thereof. Furthermore, a resilient cushion 44 is placed between the fixed yoke 30 and a dividing wall 45 of case 25.

The apparatus will comprise as many switches as there are phases in the network, with a single auxiliary electromagnet. An insulating slider then receives all the springs and stirrup pieces such as 20, 19 and dividing walls 46 of case 25 isolate adjacent phases. A spring 47 bearing on a fixed wall (of the case for example) and associated with the armature or with the slider, and a stop 48 provide for the armature a stable position when the coil is de-energized.

Figure 4:
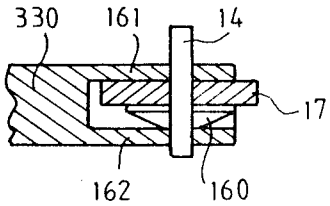
FIGS. 4 and 5 illustrate the resilient contact clip between a mobile contact lever and one of the terminals of a corresponding power circuit.
Figure 5:
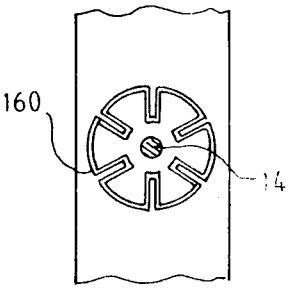

It can be seen in FIGS. 4 and 5 that the electric contact between lever 9 and an extension 330 of piece 33 which forms a fork joint 160–162, is provided by axial clamping by means of a resilient washer 160 obtained for example by the alternate and radial cutting of a Belleville type washer. This contact mode avoids using a braided connecting wire which would slow down opening of the fixed contact.

In FIG. 1, the end of arm 12 of lever 4 which cooperates with the accumulator mechanism has not been shown and its position has been shown by a broken line circle. FIG. 6 shows one embodiment of this end and of the device which provides locking of the mobile contact while allowing opening thereof under the action of the repulsion forces.

In FIG. 6, we find again the arm 12 mounted for pivoting on a pin 120 and normally rotated, for opening thereof, by an insulating piece 121. This latter is either actuated by mechanism 5 for manually controlled opening or closing and it therefore pivots through an angle $\beta$ in one direction or in the other about a fixed pin 1210 perpendicular to the plane of the Figure, or is actuated by the automatic tripping mechanism 43, in a way known per se, only in the opening direction. In both cases, rotation of piece 121 about pin 1210 causes the lever arm 12*a* to be acted on through a ball joint 1211 which itself pivots about a pin 12110 integral with piece 121, a spring 1212 and a pusher 1213. The pusher 1213 is pivotally fixed at 120*a* to the lever arm 12a and is engaged in the spring 1212 at one end thereof, whereas the ball joint is engaged in the spring at its other end. The ball joint bears on the bottom of a cavity formed in piece 121, in which the pusher and the spring move inside said cavity, the edge 12130 of the pusher coming into abutment against one or other of the lower and upper side faces of the cavity.

In the closed position of the contact, shown in the drawing, edge 12130 is in abutment against the upper side face of the cavity and the spring provides the contact pressure. The pusher and the spring are centered on an axis $\Delta 1$. Tripping results in a stable open position of the contact in which the arm 12 is also locked by the mechanism.

When a torque K appears developed by the repulsion forces which are exerted on the mobile contact in the case of a short circuit, the pusher, the spring and the ball joint pass to a second stable position in which they are centered on an axis $\Delta 2$ which forms an angle $\alpha$ with $\Delta 1$. As soon as tripping by the mechanism 43 occurs, piece 121 itself pivots through an angle $\beta$ about its axis 1210, thus confirming opening of the contact and locking of the arm 12 in the open position.

In FIGS. 7 to 10 only the fixed 50 and mobile 51 contact levers of a known type circuit breaker have been shown, comprising arc extinction fins 52. An electromagnet 53 provides remote controlled opening of the mobile contacts by means of an external signal. The mobile armature 54 of this electromagnet drives a rake 55 with a translational movement whose cross piece 56 forms a plurality of shells such as 57 (equal in number to the number of switching means). A single one of these shells has been shown in the elevational view in FIG. 7, where it can be seen that the rake is connected to the armature 54 by two arms such as 58. These latter enclose the magnetic circuit formed by the armature 54 and the fixed half yoke 59 and are hitched to the armature by means of pivot screws such as 60.

Figure 7:
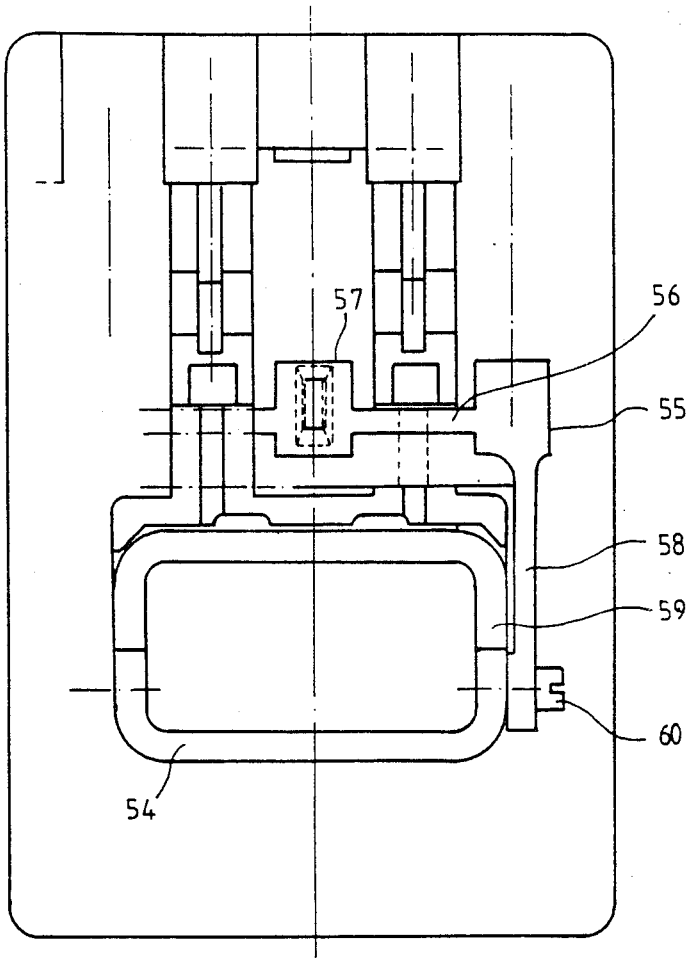
FIGS. 7 to 10 show a second embodiment of a circuit breaker with automatic control.
Figure 8:
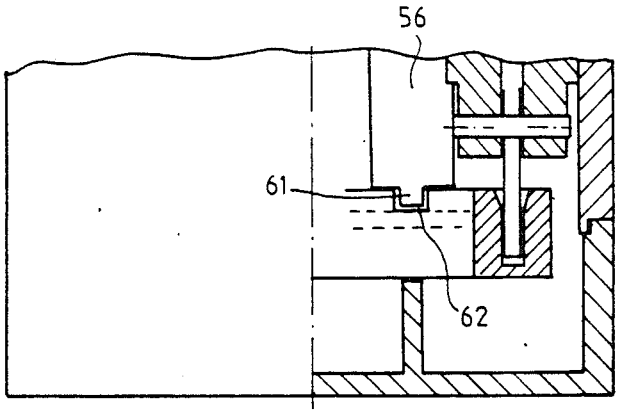
Figure 10:
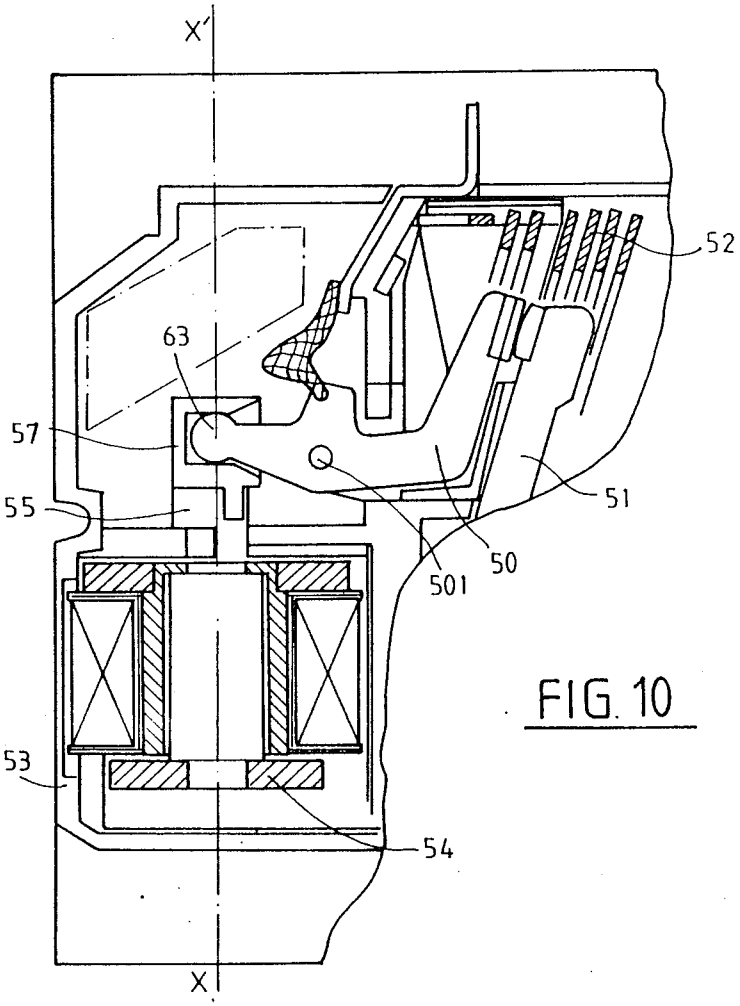
Figure 9:
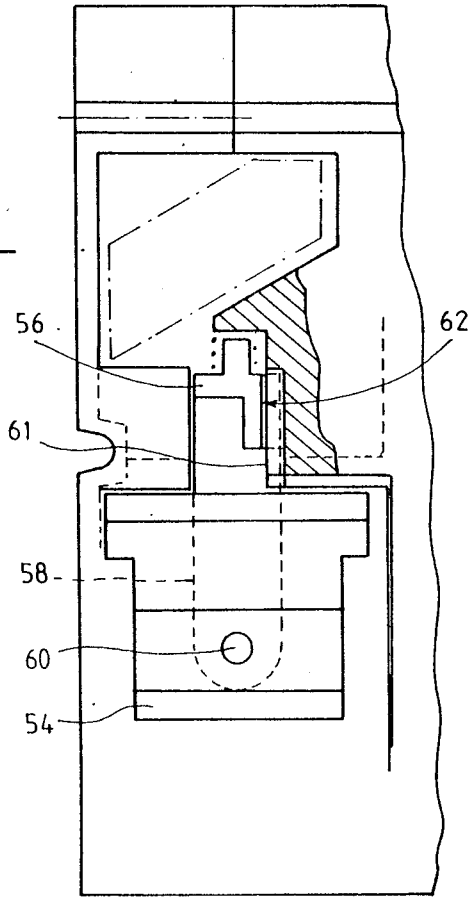

The cross piece 56 comprises a rib 61 guided in a groove 62 formed in the case of the apparatus, as can be seen in FIG. 9, which is a sectional view through a plane perpendicular to that of FIG. 7, but offset with respect to the axis of symmetry of the electromagnet. The partial view of FIG. 8 shows the detail of the guiding. The cross piece is thus guided in translation parallel to the movement of the armature, adjustment if required being effected by means of the screws 60.

Each shell 57 forms a housing which receives a ball joint 63 (FIG. 10) formed at the end of lever 50 and centered on the axis X'X of displacement of the armature. It can be seen that the pivot plane 501 of lever 50 is closer to this ball joint than the bend which its opposite arm comprises and beyond which the end portion of said opposite arm is parallel to the mobile contact lever. With such a form and arrangement of the fixed contact lever important repulsion forces develop in case of a short circuit and, in the case of control by the electromagnet, movement of the fixed contact is considerable for a given stroke of the armature. Finally, the fixed contact opens (still in the case of control by the electromagnet) by sliding over the mobile contact and the result is a shearing effect of the beginning of welding which the arc might cause.

A disadvantage of this arrangement, with respect to the one shown in FIG. 1 where the fixed contact opens in a portion of the arc chamber comprising fins, is that it does not allow fins to be placed in the space where the retractable contact opens. To improve the cut-out power, in this embodiment the mobile contact lever comprises a locking and resilient connecting member of the kind shown in FIG. 6 (not shown in FIG. 10), which allows the repulsion forces to be used for rapid opening of the mobile contact before tripping on a short circuit.

Figure 2:
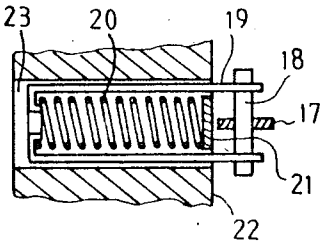
FIG. 2 shows schematically a resilient connecting element which the transmission means comprise.

The apparatus described operates in the same way as that shown in FIG. 2 by control of the opening of the retractable contact by means of an external signal applied to the electromagnet. However, the non resilient connection between the armature and the mobile contact lever does not allow opening of the fixed contact to be obtained during a short circuit.

It goes without saying that different modifications may be made by a man skilled in the art without departing from the scope and spirit of the invention.

What is claimed is

1. A circuit breaker comprising:

i. at least one switch means having a closed and an open position, said switch means comprising:

a first bent pivoting lever having first and second arms connected together by a bent portion, said first arm having a contact end provided with a first contact and a second arm having a coupling end, said first pivoting lever being pivotally mounted about a pivoting axis placed between said bent portion and said coupling end;

a second pivoting lever which comprises a third arm having a contact end provided with a second contact adapted to cooperate with the first contact, said third arm facing said first arm and extending substantially parallel thereto when said first contact is applied against said second contact in said closed position, and said first and second pivoting levers being adapted so that the first contact opens with a sliding movement over the second contact;

ii. tripping means acting on said second lever for causing rapid opening of the second contact;

iii. at least a current detector for tripping said tripping mechanism when an excessive overcurrent is flowing through said switch means;

iv. an electromagnetic actuating means comprising a mobile element movable in translation under the effect of a control signal applied to said actuating means and means for transmitting the movement of the mobile element to the first pivoting lever, said transmission means, rigid and movable in translation parallel to the axis of movement of the mobile element, being coupled to said coupling end of said pivoting lever in a position thereof which is centered on said axis.

2. A circuit breaker comprising:

i. at least one switch means having a closed and an open position, said switch means comprising:

a first bent pivoting lever having first and second arms connected together by a bent portion, said first arm having a contact end provided with a first contact and a second arm having a coupling end, said first pivoting lever being pivotally mounted about a pivoting axis placed between said bent portion and said coupling end;

a second pivoting lever which comprises a third arm having a contact end provided with a second contact adapted to cooperate with the first contact, said third arm facing said first arm and extending substantially parallel thereto when said first contact is applied against said second contact in said closed position, and said first and second pivoting levers being adapted so that the first contact opens with a sliding movement over the second contact;

ii. tripping means acting on said second lever for causing rapid opening of the second contact;

iii. at least a current detector for tripping said tripping mechanism when an excessive overcurrent is flowing through said switch means;

iv. an electromagnetic actuating means comprising a mobile element movable in translation under the effect of a control signal applied to said actuating means and means for transmitting the movement of the mobile element to the first pivoting lever, said transmission means, rigid and movable in translation parallel to the axis of movement of the mobile element, being coupled to said coupling end of said pivoting lever in a position thereof which is centered on said axis, wherein said transmission means further comprises a resilient connecting element adapted for allowing opening of the first contact under the effect of the repulsion forces generated in the case of a high current overload, whereas said mobile element is in the position of said transmission means which corresponds normally to closure of the retractable contact, said opening being sufficiently large to permit said current detector to react after a releasing time for tripping said tripping means before said switch means has come back to its closed position.

3. The circuit breaker as claimed in claim 2, wherein said second pivoting lever has an end opposite the second contact, which is itself coupled to said tripping means through a resilient connecting element so as to allow opening of the second contact under the effect of said repulsion forces when said tripping means has not yet been tripped.

4. The circuit breaker as claimed in claim 1, comprising resilient clips for transmitting current between said first pivoting lever and a terminal of a corresponding power circuit.

5. The circuit breaker as claimed in claim 1, wherein said actuating means comprise an electromagnet having a fixed yoke, a coil and an armature which forms said mobile element, said fixed yoke being firmly fixed to a sleeve on which the coil is fitted and inside which slides a core integral with the armature, said core comprising segments allowing low friction sliding without play and a damping piece being placed between the bottom of the sleeve and the corresponding end of the core.

6. The circuit breaker as claimed in claim 1, wherein said first pivoting lever has, between its pivoting axis and its coupling end, two bends adapted so that opening of the retractable contact takes place with substantial separation.

7. A circuit breaker comprising:

i. at least one switch means having a closed and an open position, said switch means comprising:

a first bent pivoting lever having first and second arms connected together by a bent portion, said first arm having a contact end provided with a first contact and a second arm having a coupling end, said first pivoting lever being pivotally mounted about a pivoting axis placed between said bent portion and said coupling end;

a second pivoting lever which comprises a third arm having a contact end provided with a second contact adapted to cooperate with the first contact, said third arm facing said first arm and extending substantially parallel thereto when said first contact is applied against said second contact in said closed position, and said first and second pivoting levers being adapted so that the first contact opens with a sliding movement over the second contact;

ii. tripping means acting on said second lever for causing rapid opening of the second contact;

iii. at least a current detector for tripping said tripping mechanism when an excessive overcurrent is flowing through said switch means;

iv. an electromagnetic actuating means comprising a mobile element movable in translation under the effect of a control signal applied to said actuating means and means for transmitting the movement of the mobile element to the first pivoting lever, said transmission means, rigid and movable in translation parallel to the axis of movement of the mobile element being coupled to said coupling end of said pivoting lever in a position thereof which is centered on said axis, wherein said transmission means comprise a stirrup piece, mounted for pivoting at the coupling end of said first pivoting lever and between the legs of which is placed a compression spring which bears on a cross piece carried by an insulating slider having a housing for guiding the stirrup piece parallel to said movement of the mobile element and rigid connection means between said slider and said mobile element, said cross piece being disposed so as to come into abutment against the first pivoting lever for causing opening of the first contact when said mobile element is actuated and for being moved by said first pivoting lever while compressing the spring without moving the slider when the first contact opens under the effect of said repulsion forces.

8. The circuit breaker as claimed in claim 7, which comprises several switch means, wherein said transmission means comprise a rake having two legs hitched to the mobile element and a cross piece guided in translation parallel to the movement of the mobile element and having shells forming housings which receive ball joints formed at the coupling end of the first pivoting levers of said switch means and centered on the displacement axis of the mobile element.

* * * * *